US006708585B1

(12) United States Patent
Posenauer

(10) Patent No.: US 6,708,585 B1
(45) Date of Patent: Mar. 23, 2004

(54) NAIL DRIVER

(76) Inventor: Charles R. Posenauer, 7707 N. 13th St., Phoenix, AZ (US) 85020

( * ) Notice: Subject to any disclaimer, the term of this patent is extended or adjusted under 35 U.S.C. 154(b) by 0 days.

(21) Appl. No.: 10/367,089

(22) Filed: Feb. 14, 2003

Related U.S. Application Data

(60) Provisional application No. 60/357,422, filed on Feb. 15, 2002.

(51) Int. Cl.[7] ..... B25D 1/00

(52) U.S. Cl. ..... 81/27; 81/463; 29/255; 29/263

(58) Field of Search ..... 81/27, 463; 27/27; 29/255, 263, 280, 278

(56) References Cited

U.S. PATENT DOCUMENTS 4,034,594 A * 7/1977 Morgan ..... 72/457
4,085,882 A * 4/1978 Stamper ..... 227/110
4,483,475 A * 11/1984 Whitaker ..... 227/147
5,504,982 A * 4/1996 Sharp ..... 29/255
5,605,271 A * 2/1997 Russell ..... 227/147
6,434,807 B1 * 8/2002 Begin ..... 29/227

* cited by examiner

*Primary Examiner*—Lee D. Wilson
*Assistant Examiner*—Alvin J. Grant
(74) *Attorney, Agent, or Firm*—Gregory J. Nelson

(57) ABSTRACT

A driver tool for small nails and brads having a tubular body within which a plunger is reciprocal. The upper end of the plunger and the body are connected by an elastomeric member so that a manual force may be applied to draw the plunger upward. Upon release, the plunger descends to impact the nail or brad within the lower end of the tubular body. The lower driver head end of the plunger is magnetized.

3 Claims, 1 Drawing Sheet

10
12
14
16
18
20
22
25
26
30
32
N
S

NAIL DRIVER

CROSS REFERENCE TO RELATED APPLICATION

This application is based on provisional patent application Serial No. 60/357,422, filed Feb. 15, 2002, entitled "Nail Driver."

FIELD OF THE INVENTION

The present invention relates to a hand tool and more particularly relates to a nail driver for small brads and nails.

BACKGROUND OF THE INVENTION

There are many instances in which it is difficult to drive a nail or brad using a conventional tool such as a hammer. In close or tight areas or areas which have obstructions, it is often not possible to accurately and squarely strike the head of the nail causing it to bend or become dislodged. Nails, particularly small nails or brads, are often driven with a small hammer and the worker must secure the nail in place with pliers until the nail is set. Once the nail is driven, finish work often requires that the nail be countersunk which requires striking the nail area with a hammer or using a countersink. Again, it may be difficult to access the location of the nail head and, further, countersinking operation may damage the nailing surface.

As a result, various mechanical and hand-held nailers can be found in the prior art. Most mechanical nailers require that the force be applied perpendicular to the nailing surface. This requires a downward impacting force that may not be possible when the worker is in a position with arms outstretched reaching to the nailing location.

Further, many mechanical nailers will place unnecessary and excessive pressure on a nailing surface which, when working on precision items such as small-scale models, may cause the model to bend or become damaged.

The prior patent art contains various patents on nail drivers. U.S. Pat. No. 4,483,475 discloses a hand-held nail driver. This device includes a cylindrical guide tube and a plunger rod. A handle is mounted on one end of the plunger rod and the plunger rod is inserted into the guide tube. A nail is placed into the guide tube and a handle is moved to cause the plunger to strike the nail driving the nail into a surface. The guide tube is then held in place as the handle is pulled back to retract the plunger rod from the guide tube.

U.S. Pat. No. 5,605,271 entitled "Nail Driver" shows a driver in which the nail is held within a cylindrical nail chamber by a magnetized cylindrical driver rod. A driver sleeve is concentric with the nail chamber and attached to the rearward end of the drive rod. As the driver sleeve is moved towards the surface, the driver rod drives the nail into the surface. A coil spring attached between a chamber guide nut on the driver sleeve and the nail chamber biases the nail driver in the extended position. A reinforcement cap between the driver rod and the driver sleeve is adjustable to adjust the distance that the nail is driven into the surface.

While nail drivers such as those described above, may be effective, there nevertheless exists a need for an inexpensive and simple nail driver that can be used in tight areas.

It is an object of the present invention to provide a nail driver for use in driving small brads and nails and which can be used by those engaged in constructing model railroads, dollhouses, architectural models, ships and other precision or fragile items.

BRIEF SUMMARY OF THE INVENTION

Briefly, the present invention provides a nail driver having a generally tubular body defining a longitudinally extending bore. A plunger is reciprocal in the bore. The plunger is rod-like and has a driver head at its lower end which is preferably magnetized. The upper end of the plunger extends from the upper end of the tubular body and terminates at a loop or other configuration which can be easily grasped between the fingers of the user. A hook extends from the exterior of the body disposed adjacent the lower end of the body. An elastomeric member, such as a rubber band, extends between the upper loop and the lower hook. By pulling up on the top loop, the magnetized rod will draw a nail or brad into the lower end of the tube. The lower end of the body can then be placed on the working surface at the desired location. The plunger is manually pulled upwardly against the biasing force of the rubber band and then released causing the plunger to impact and drive the nail. The steps can be repeated as necessary if a single blow does not completely sink the nail.

BRIEF DESCRIPTION OF THE DRAWINGS

The above and other objects and advantages of the present invention will be more fully understood from the following description, claims and drawings in which:

DETAILED DESCRIPTION OF THE DRAWINGS

Figures 1, 2, 3, 4, 5, 6:
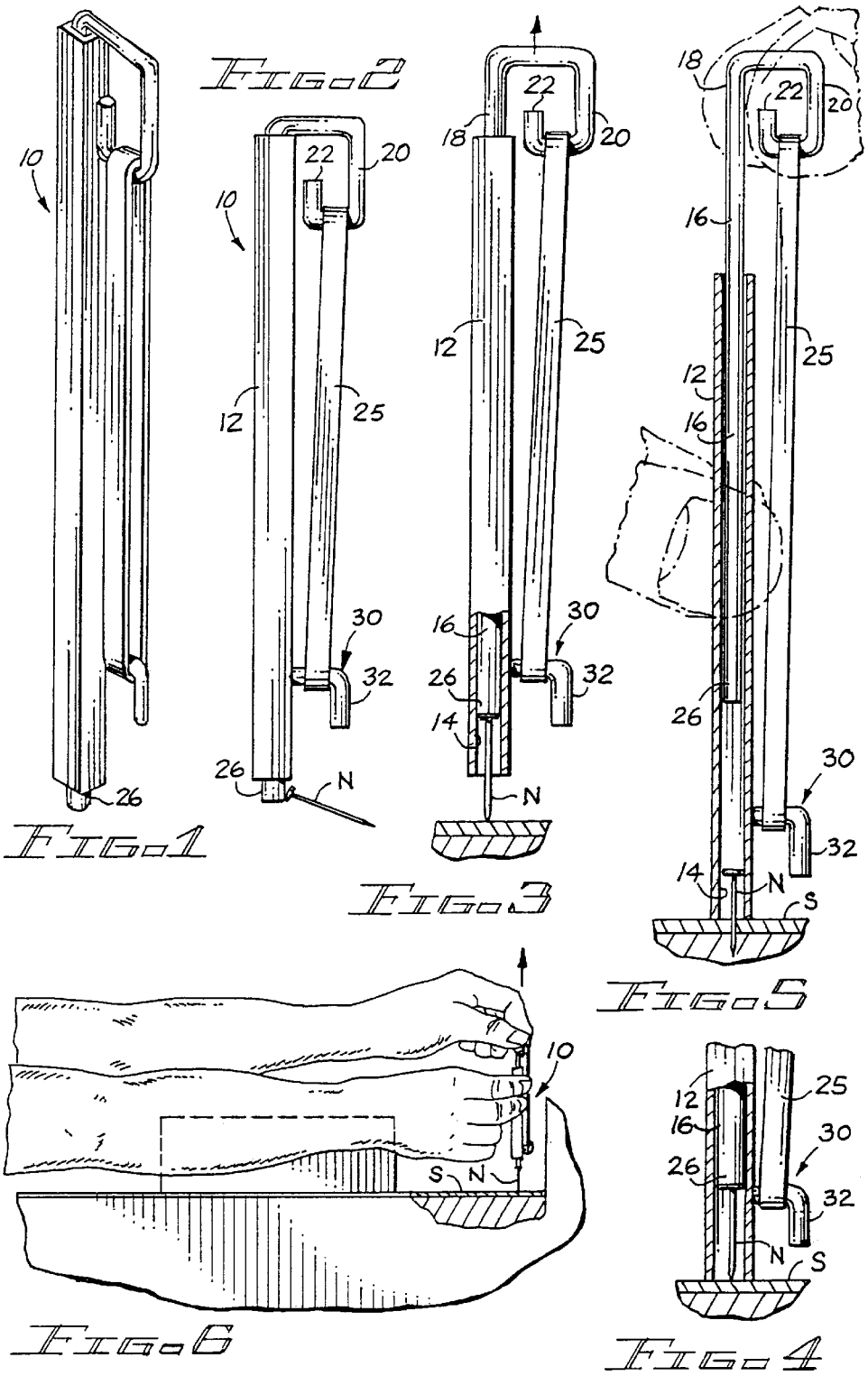
FIG. 1 is a perspective view of the nail driver of the present invention in a non-use position.
FIG. 2 is a side view of the nail driver showing the magnetized tip extended and a nail magnetically attached to the plunger.
FIG. 3 is a side view of the nail driver partly in section showing the nail driver positioned above a nailing surface.
FIG. 4 is a detail view of the lower end of the nail driver and nailing surface showing the plunger in a partially retracted position with the nail to be driven retained within the lower end of the tube.
FIG. 5 is a side view of the nail driver partly in sections showing the plunger in an armed position and ready to be released to sink the nail.
FIG. 6 illustrates the use of the nail driver with the user's arms extended.

Turning now to the drawings, the nail driver of the present invention is generally designated by the numeral 10 and has an elongated tubular body 12 which defines an internal bore 14 extending the length of the body. The body exterior may be square or round tube and receives a reciprocal plunger 16 in the bore. The plunger 16 has an upper end 18 which extends from the upper end of the body. The upper end 18 is configured into a loop 20 which terminates at end 22. End 22 is preferably turned upwardly and spaced a slight distance from the periphery of the upper end of the plunger so that an elastomeric member 25, such as a rubber band, can be secured within the loop as shown in FIGS. 1 to 3.

The lower end of the plunger forms a driver head 26, which, in the normal, non-actuated position, extends from the lower end of the tubular body. Preferably the driver head is magnetized so that it will attract small nails or brads N, as seen in FIGS. 2, 3 and 4, in order to draw them into the lower end of the tube in a position to be struck.

A hook 30 with a downwardly depending leg 32 is secured to the exterior of the tubular body 12 adjacent the lower end.

In use, the user will grasp the body 12 between the thumb and forefinger, as seen in FIG. 5. In the non-actuated position, the tip or driver head 26 extends from the lower end of the plunger and is placed adjacent the metal nail. The metal nail N is attracted to the lower end of the rod as shown in FIG. 2.

The user will then grasp the upper loop 20 applying an upwardly manual force to withdraw the lower end of the driver rod into the internal bore. This will cause the nail, which is magnetically attracted to the lower end of the rod to be brought into the position shown in FIG. 3 in which it is axially aligned within the bore of the rod. The user will then push the body 12 downwardly to a flush position against the nailing surface "S," as shown in FIG. 4. The rod can then be manually pulled upwardly to an extended arm position shown in FIG. 5 using the thumb and fingers of the opposite hand. The loop 20 is quickly released which allows the plunger to be pulled downwardly due to the biasing force exerted by the elastomeric member. The lower driver end 26 of the rod will strike the nail head to drive the nail into position. The procedure may be repeated as necessary.

From the foregoing, it will be seen that the tool of the present invention is simple to use and can be inexpensively manufactured and provided to consumers at a very reasonable price. The driving force is provided by a replaceable elastic member, such as a rubber band, which is in a convenient position exterior of the body so that it can be replaced as necessary without the use of any tools or disassembly. The rubber band can simply be slipped over the lower hook 30 and inserted into the interior of the upper loop.

The driver tool has primary use for individuals working on model railroads, dollhouses, architectural models, model ships and similar projects where spaces are tight. The device can be inserted into a tight space such as a corner or around an obstacle and will still deliver sufficient force to drive a nail, as for example up to 1 ¼ inch finish nail. The driving force is sufficient to penetrate most wood surfaces, and even some synthetic surfaces such as counter surfaces of Formica or similar material. The tool 10 can even be used in locations where it is necessary for the user to hold the tool with out-stretched arms as seen in FIG. 6.

From the foregoing it will apparent that various changes, alterations and modifications may be made to the invention as described herein. It should be apparent to those skilled in the art that the invention is not so limited in the various changes, alterations and modifications are intended to be included in the spirit and scope of the invention and the appended claims.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A driver tool for a small nail or brad comprising:

(a) a tubular body having upper and lower ends defining a bore;

(b) a plunger slidable in the bore, said plunger having a lower driving end and an upper end with a lop extending from the upper end of the body;

(c) a hook on said body adjacent the lower end thereof; and (d) an elastomeric member extending between said loop and said hook external of the body.

2. The tool of claim 1 wherein said plunger lower end is magnetized.

3. The tool of claim 1 wherein said elastomeric member is a rubber band.

* * * * *